US006431132B1

(12) United States Patent
Yamauchi et al.

(10) Patent No.: US 6,431,132 B1
(45) Date of Patent: Aug. 13, 2002

(54) VALVE TIMING CONTROL DEVICE

(75) Inventors: Makoto Yamauchi; Hiroyuki Kinugawa, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/961,271

(22) Filed: Sep. 25, 2001

(30) Foreign Application Priority Data

Mar. 5, 2001 (JP) ..... 2001-060774

(51) Int. Cl.[7] ..... F01L 1/344
(52) U.S. Cl. ..... 123/90.17
(58) Field of Search ..... 123/90.15, 90.17, 123/90.19, 90.31

(56) References Cited

U.S. PATENT DOCUMENTS 5,901,674 A * 5/1999 Fujiwaki ..... 123/90.17
6,192,844 B1 * 2/2001 Scheidt et al. ..... 123/90.17
6,308,672 B1 * 10/2001 Lichti et al. ..... 123/90.17

FOREIGN PATENT DOCUMENTS

JP 10-047021 2/1998

* cited by examiner

*Primary Examiner*—Weilun Lo
(74) *Attorney, Agent, or Firm*—Sughrue Mion, PLLC

(57) ABSTRACT

A valve timing control device has an input rotational member 3, a case 4, and a cover member 10, which constitute a housing 2. A threaded member 11 such as a bolt is used for being integrated with the cover member 10, the case 4 and the input rotational member 3. A welding section 20 is formed at the bolt 11 to prevent the loosening and detachment of the bolt 11.

10 Claims, 4 Drawing Sheets

VALVE TIMING CONTROL DEVICE

BACKGROUND OF THE INVENTION

1. Field of the Invention

The present invention relates to a valve timing control device for modifying the opening and closing timing of at least one of an intake or an exhaust valve in an internal combustion engine (hereafter, referred as an engine) in response to any operating condition.

2. Description of the Prior Art

FIG. 1 is a longitudinal cross sectional view of a conventional valve timing control device. FIG. 2 is a longitudinal cross sectional view taken along lines A—A of FIG. 1.

In FIG. 1, reference numeral 1 denotes a camshaft opening and closing the intake and exhaust valves in the internal combustion. Numeral 2 denotes a housing, which is rotatably fitted in and held on the camshaft 1. The housing 2 includes an input rotational member 3 constituted by a timing-sprocket or a timing-pulley inputting a rotational driving force from a crankshaft (not shown) of the engine to this device; and a cylindrical-shaped case 4 having a through hole, fixedly mounted on a side of the input rotational member 3. A plurality of shoes 5 extend to a rotational center of the camshaft 1, and are integrated into an inner circumferential face of the case 4 as shown in FIG. 2.

Numeral 6 denotes a rotor, which is rotatably accommodated into the case 4 and is fixedly coupled to the camshaft 1. The rotor 6 includes a boss 7 rotatably fitting into the camshaft 1 to act as a rotational body; and a plurality of vanes 8 equal to the number of shoes 5, the respective vanes extending in a radial direction of the boss 7. The rotor 6 is coupled to the camshaft 1 by using an axial bolt 9 to allow rotation integral with the camshaft 1.

Numeral 10 denotes a cover member assembled at a side of the case 4, the side being opposite to the side disposing the input rotational member 3. Numeral 11 denotes a threaded member integrally securing the cover member 10, the input rotational member 3 and the case 4. The threaded member (hereafter, referred as a bolt) 11 passes through the cover member 10, the input rotational member 3 and the case 4 in the axial direction. The bolt 11 has a head section 11*a* making contact with an outer side face of the cover member 10, and a front side of the head section 11*a* is a threaded section allowing insertion into a part of the case 4 and the input rotational member 3. The cover member 10 has a bolt through hole 10*a*. The case 4 has a bolt through hole 4*a* close to the cover member 10; and a bolt threaded hole 4*b* close to the input rotational member 3, wherein the hole 4*a* and the hole 4*b* are coaxial. The input rotational member 3 has a bolt threaded hole 3*a*.

Numeral 12 denotes a first hydraulic passage arranged in the camshaft 1 and the rotor 6 to communicate with a retardation side hydraulic pressure chamber 14 as described later. Numeral 13 denotes a second hydraulic passage arranged in the camshaft 1 and the rotor 6 to communicate with an advance side hydraulic pressure chamber 15 as described later.

In FIG. 2, numeral 14 denotes a retardation side hydraulic pressure chamber moving the vanes 8 of the rotor 6 in a retardation direction due to a hydraulic pressure supplied. Numeral 15 denotes an advance side hydraulic pressure chamber moving the vanes 8 in an advance direction due to a hydraulic pressure supplied. Each chamber is constituted by a fan-tailed space defined between the case 4 and the rotor 6 and between the respective shoes 5 and the respective vanes 8, wherein an actuating-oil is supplied to the fan-tailed space.

Numeral 16 denotes a seal member arranged at a front end of the respective shoes 5 of the case 4. Numeral 17 denotes a rear-spring (a leaf spring) of the seal member 16. Numeral 18 denotes a seal member arranged at a front endof the respective vanes 8 of the rotor 6. Numeral 19 denotes a rear-spring (a leaf spring) of the seal member 18. Each seal member creates a seal between the inner radius of the case 4 and a junction face of the vane 8 and between the perimeter of the boss 7 of the rotor 6 and a junction face of the shoe 5 to prevent communication between both chambers 14 and 15.

Moreover, the housing 2 and the rotor 6 are locked or released due to a lock means (not shown) actuating according to the conditions. On locking, the housing 2 rotates in synchronization with the rotor 6. on releasing, the housing 2 rotates relative to the rotor 6.

Next, an operation will be explained.

When the inner combustion is operated, a rotational force of the crankshaft (not shown) of the inner combustion is transmitted to the input rotational member 3. Thus, the input rotational member 3 rotates in synchronization with the housing 2. Here, as the housing 2 and the rotor 6 are locked, the housing 2 and the rotor 6 are rotated in synchronization with the camshaft 1. In this way, a cam (not shown) fixedly coupled on the camshaft 1 rotates to open and close the intake and exhaust valves of the engine. Here, a hydraulic pressure from a hydraulic pressure control system is selectively supplied to the retardation side hydraulic pressure chamber 14 or the advance side hydraulic pressure chamber 15 according to the conditions. In this way, the rotor 6 rotates due to a pressure difference between the retardation side hydraulic pressure chamber 14 and the advance side hydraulic pressure chamber 15, and accordingly allows automatic controlling of the opening and closing timing of the intake and exhaust valve.

The conventional valve timing control device is constituted as described above. When the cover member 10, the case 4 and the input rotational member 3 are integrated into the housing 2, the bolt 11 is simply screwed in the bolt threaded hole 4*b* of the case 4 and the bolt threaded hole 3*a* of the input rotational member 3 via the bolt through hole 10*a* of the cover member 10. As a result, there is a problem that the bolt 11 becomes loose or detaches due to the vibration caused by driving the internal combustion at high speed.

Concretely, as the bolt 11 becomes loose, a gap is defined between the junction faces between the input rotational member 3 and the case 4 and the junction faces between the case 4 and the cover member 10. As a result, oil leaks from the retardation side hydraulic pressure chamber 14 or the advance side hydraulic pressure chamber 15 and results in adverse effects on the control of the opening and closing timing of the valves. In a worst scenario, if the bolt 11 continues to become loose, it may detach. If the bolt 11 detaches and falls into the engine room, there is a problem that the bolt 11 gets caught in the moving parts of the internal combustion. Furthermore, when the expansion coefficient of the housing 2 is different from that of the bolt 11, the bolt 11 may become loose due to changes in temperature of the internal combustion. As a result, the leakage of oil from the retardation side hydraulic pressure chamber 14 or the advance side hydraulic pressure chamber 15 is increased and results in reduced performance in controlling the valve timing control device.

SUMMARY OF THE INVENTION

Accordingly, the present invention is made to resolve the problems above, and it is an object of the present invention to provide a valve timing control device, which ensures reliability of the device, and increases durability thereof, without loosening and detachment of a threaded member due to the vibration. The threaded member is used for coupling integrally components of the housing accommodating the rotor therein.

In order to achieve the object of the present invention, a valve timing control device comprises a camshaft opening and closing at least one intake and exhaust valves in an internal combustion; an input rotational member arranged on the camshaft to input the rotational driving force of the internal combustion; a case whose end is assembled in the input rotational member in an axial direction of the case; a rotor accommodated in the case to rotate relative to the case and coupled to the camshaft; a cover member disposed at the other end of the case in the axial direction; a threaded member used for being integrated with the cover member, the case and the input rotational member; and a detachment prevention means arranged at the threaded member to prevent the loosening and detachment of the threaded member. In this way, the threaded member is not detached or loosened due to the vibration caused by driving the internal combustion. It is therefore possible to prevent oil leaks resulting from the loosening of the threaded member and prevent the internal combustion from failure resulting from the detachment of the threaded member. As a result, it is possible to ensure reliability of the device, and increases durability thereof.

The threaded member may be a bolt including a head section engaging in any one of the cover member and the input rotational member; and a front end allowing threadable attachment with the other of the cover member and the input rotational member. The threadably attached front end of the bolt may be further welded to the other member, the welds constituting the detachment prevention means. In this way, the threaded member is not detached or loosened due to the vibration caused by driving the internal combustion. It is therefore possible to prevent oil leaks of a hydraulic control system of the valve timing control device and prevent the internal combustion from failing. As a result, it is possible to ensure reliability of the device, and increases durability thereof.

The threaded member may be a bolt including a head section engaging in any one of the cover member and the input rotational member; and a front end allowing threadable attachment with the other of the cover member and the input rotational member. The threadably attached front end of the bolt may be further swaged and fixed to the other member, the swaging section constituting the detachment prevention means. In this way, the threaded member is not detached or loosened due to the vibration caused by the engine. It is therefore possible to prevent oil leaks of a hydraulic control system of the valve timing control device and prevent the internal combustion from failing. As a result, it is possible to ensure reliability of the device, and increase durability thereof.

The threaded member may be a bolt including a head section engaging in any one of the cover member and the input rotational member; and a front end allowing threadable attachment with the other of the cover member and the input rotational member. An adhesive acting as the detachment prevention means may be further applied to the threaded section of the bolt. In this way, even if the bolt becomes loose, it is possible to reduce the loosening to a very slight level due to the adhesion properties of the adhesive in order to prevent the bolt from detaching.

The valve timing control device may comprise a camshaft opening and closing at least one intake and exhaust valves in an internal combustion; an input rotational member arranged on the camshaft to input the rotational driving force of the internal combustion; a case whose end assembled in the input rotational member in an axial direction of the case; a rotor accommodated in the case to rotate relative to the case and coupled to the camshaft; a cover member disposed at the other end of the case in the axial direction; a threaded member used for being integrated with the cover member, the case and the input rotational member; and a loosening prevention means arranged at the threaded member to prevent the loosening of the threaded member using the screwing force of the threaded member. In this way, the threaded member does not detach or become loose due to the vibration caused by driving the internal combustion. It is therefore possible to prevent oil leaks resulting from the loosening of the threaded member and prevent the internal combustion from failure resulting from the detachment of the threaded member. As a result, it is possible to ensure reliability of the device, and increases durability thereof.

The threaded member may be a bolt including a head section engaging in any one of the cover member and the input rotational member; and a front end allowing threadable attachment with the other of the cover member and the input rotational member. A spring-washer acting as the loosening prevention means may be further disposed between the head section and one of the members engaged with the head section. In this way, it is possible to enhance the engaging strength acting on both threaded sections formed at a housing-constituting member close to the front end of the bolt and at the front end of the bolt. As a result, it is possible to prevent the loosening and detachment of the bolt.

The threaded member may be a bolt including a head section engaging in any one of the cover member and the input rotational member; and a front end allowing threadable attachment with the other of the cover member and the input rotational member. A seat of the head section may further have a rough surface acting as the loosening prevention means. In this way, it is possible to produce a sufficient strength between the seat of the head section of the bolt and the housing-constituting member. As a result, it is possible to prevent the loosening and detachment of the bolt.

The threaded member may be a countersunk bolt whose tapered section acts as a seat of the head section. In this way, it is possible to produce a sufficient strength between the seat of the head section of the countersunk bolt and the housing-constituting member. As a result, it is possible to prevent the loosening and detachment of the countersunk bolt.

The threaded member may be made of materials whose expansion coefficient is smaller than or equal to that of materials of the case, the input rotational member and the cover member which constitute a housing. In this way, it is possible to effectively prevent the loosening of the threaded member due to changes in temperature of the internal combustion.

DESCRIPTION OF THE PREFERRED EMBODIMENT OF THE INVENTION

Hereafter, one embodiment according to the present invention will be explained.

Embodiment 1

Figure 1:
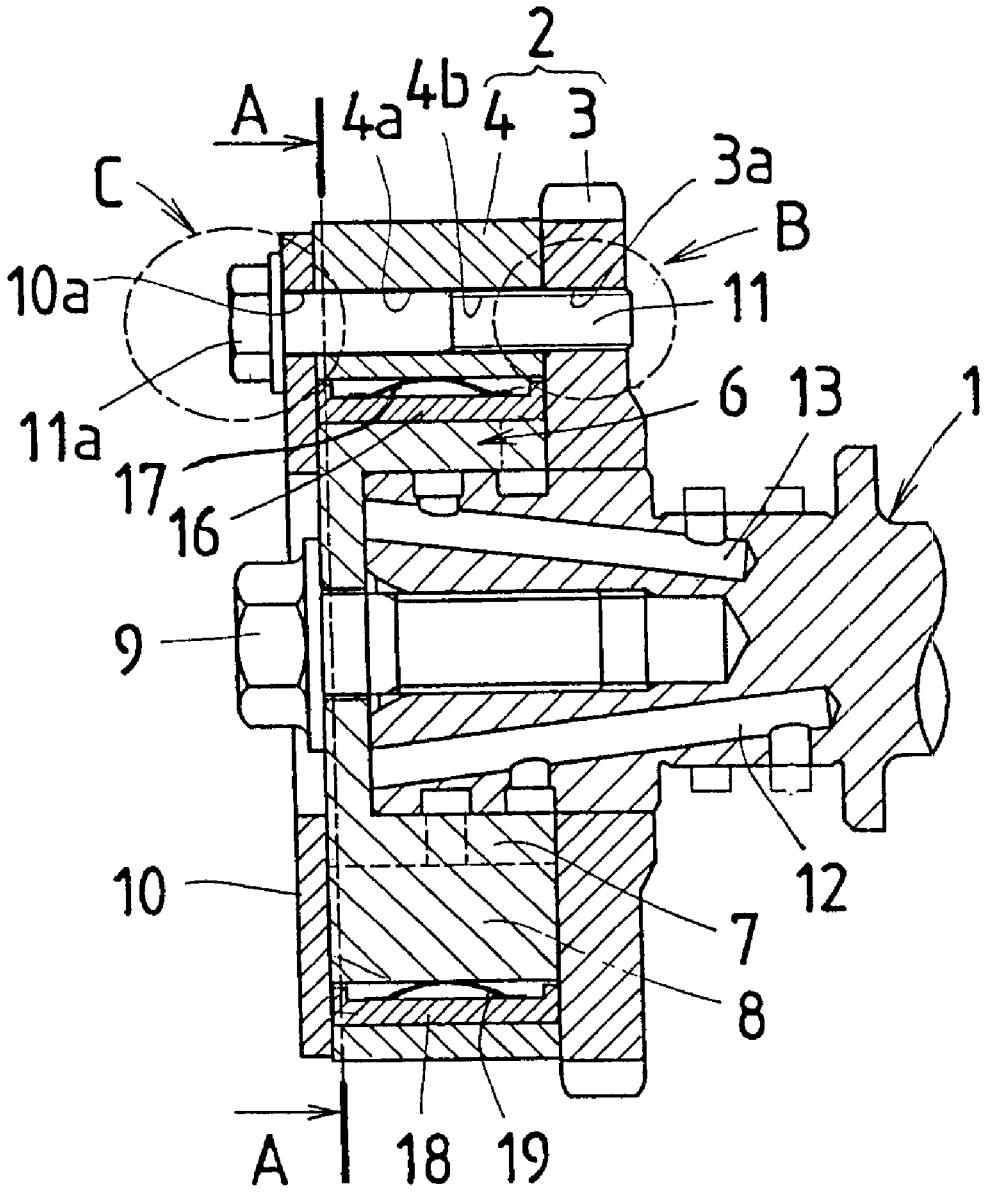
FIG. 1 (PRIOR ART)
FIG. 1 is a longitudinal cross sectional view of a conventional valve timing control device.
Figure 2:
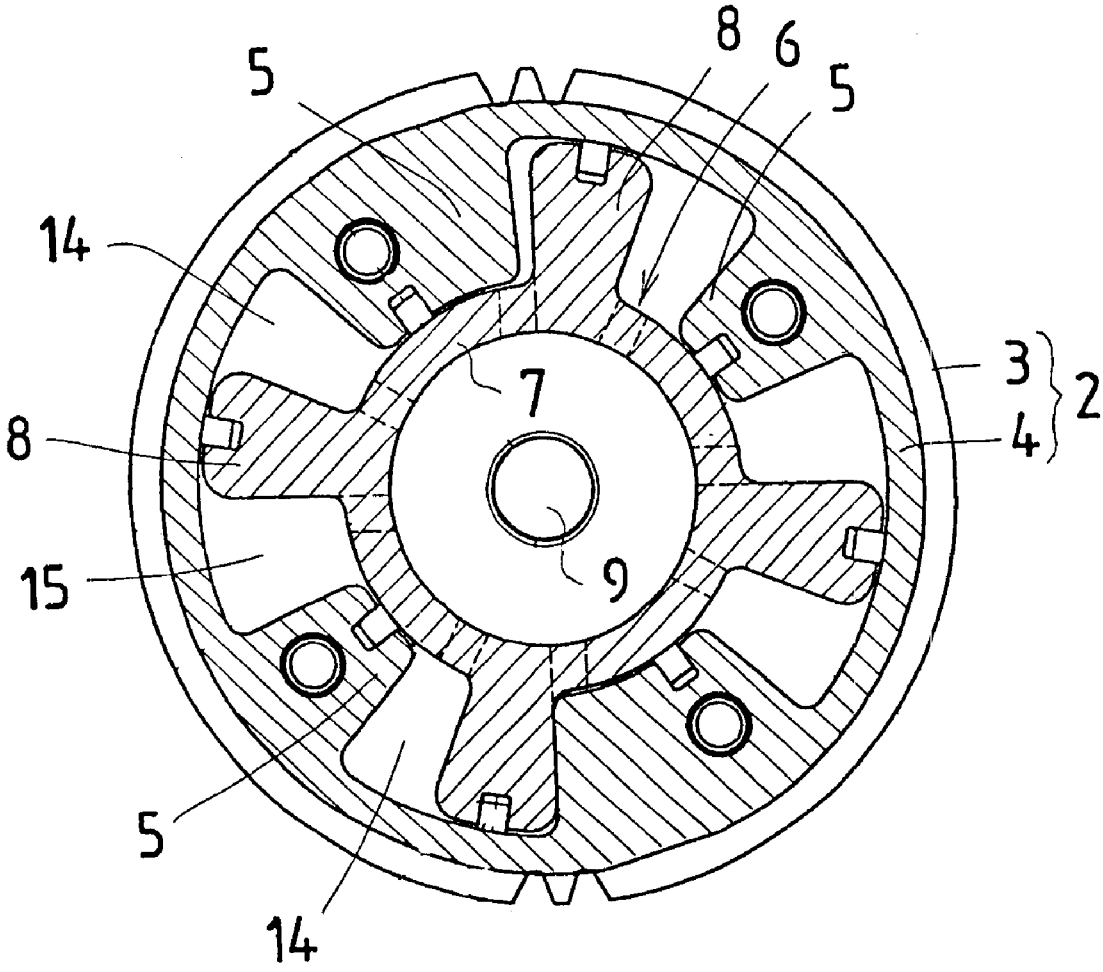
FIG.2 (PRIOR ART)
FIG. 2 is a longitudinal cross sectional view taken along lines A—A of FIG. 1.
Figure 3A:
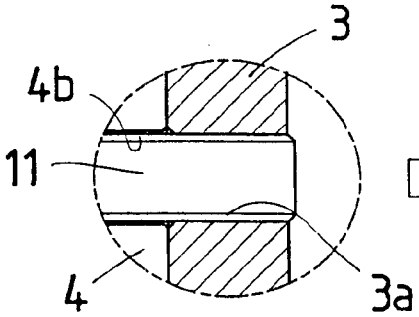
FIG. 3A is an enlarged fragmentary cross sectional view showing a part corresponding to part B of FIG. 1.
Figure 3B:
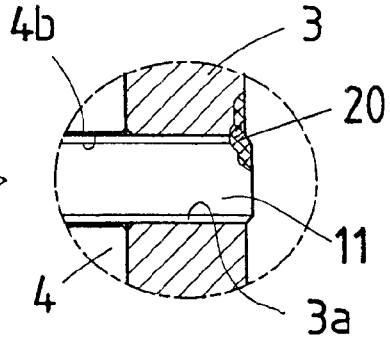
FIG. 3B is a longitudinal cross sectional view of main points of a valve timing control device as embodiment 1 according to the present invention, and shows a state after welding a threaded member to an input rotational member shown in FIG. 3A.

FIG. 3A is an enlarged fragmentary cross sectional view showing a part corresponding to part B of FIG. 1. FIG. 3B is a longitudinal cross sectional view of main points of a valve timing control device as embodiment 1 according to the present invention, and shows a state after welding a threaded member to an input rotational member shown in FIG. 3A. Since the common numerals of the embodiment 1 denote common elements in the conventional device of FIG. 1 and FIG. 2, the description of such parts is omitted.

In FIG. 3B, numeral 20 denotes a welding section welding the input rotational member 3 to the bolt (threaded member) 11. With the embodiment 1, the input rotational member 3, the case 4 and the cover member 10, which are the same components as the conventional device of FIG. 1 and FIG. 2, are integrated by threadable attachment of the bolt 11 in a manner similar to the prior art. The front end of the bolt 11 is then welded to the input rotational member 3. The welding section 20 means as a detachment prevention means to prevent the loosening and detachment of the bolt 11.

According to the embodiment 1 described above, the housing 2 can be assembled by simply screwing the bolt 11 in the bolt threaded hole 4*b* of the case 4 and the bolt threaded hole 3*a* of the input rotational member 3 via the bolt through hole 10*a* of the cover member 10. The front end of the bolt 11 is then welded to the input rotational member 3. In this way, the bolt 11 does not detach or become loosened due to the vibration caused by driving the internal combustion. It is therefore possible to prevent oil leaks and prevent the internal combustion from failure. As a result, it is possible to ensure reliability of the valve timing control device, and increases durability thereof.

Embodiment 2

Figure 4A:
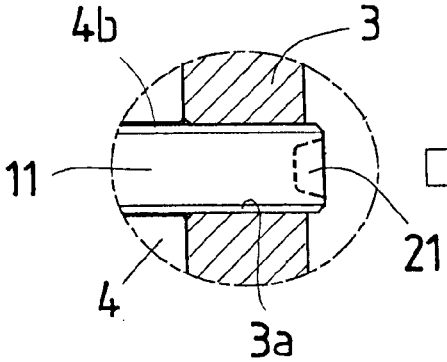
FIG. 4A is an enlarged fragmentary cross sectional view showing a part corresponding to part B of FIG. 1.
Figure 4B:
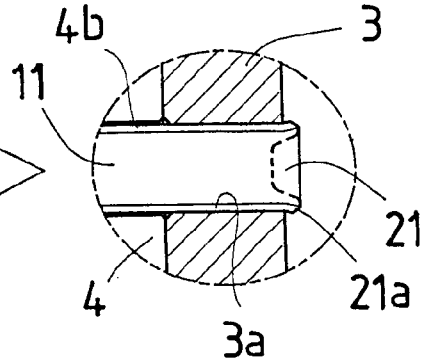
FIG. 4B is a cross sectional view of main points of a valve timing control device as embodiment 2 according to the present invention, and shows a state after swaging a threaded member to an input rotational member shown in FIG. 4A.

FIG. 4A is an enlarged fragmentary cross sectional view showing a part corresponding to part B of FIG. 1. FIG. 4B is a cross sectional view of main points of a valve timing control device as embodiment 2 according to the present invention, and shows a state after swaging a threaded member to an input rotational member shown in FIG. 4A. Since the common numerals of the embodiment 2 denote common elements in the conventional device of FIG. 1 and FIG. 2 and common elements in the embodiment 1, the description of such parts is omitted.

In FIG. 4A and FIG. 4B, numeral 21 denotes a recess arranged at the front end of the bolt 11. Numeral 21*a* denotes a swaging section formed by outwardly bending a peripheral wall of the recess 21 to swage the peripheral wall toward an outer side face of the input rotational member 3. With the embodiment 2, after the front end of the bolt 11 is screwed in the bolt threaded hole 3*a* of the input rotational member 3 on assembling the housing 2 in a manner similar to the case of FIG. 3A and FIG. 3B, the recess 21 is used to fix them. In brief, the peripheral wall of the recess 21 is swaged toward the outer side face of the input rotational member 3. In this way, the swaging section 21*a* acts as the detachment means to prevent the loosening and detachment of the bolt 11. The embodiment 2 has therefore the same effect as the embodiment 1.

Embodiment 3

Figure 5C:
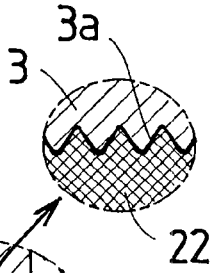
FIG. 5C is an enlarged fragmentary cross sectional view showing part D of FIG. 5B.
Figure 5A:
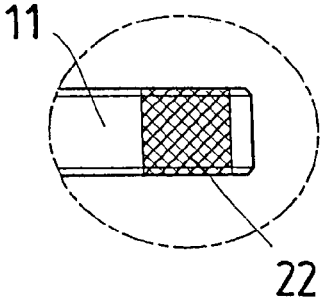
FIG. 5A is an enlarged fragmentary cross sectional view showing a bolt before adhering to an input rotational member.
Figure 5B:
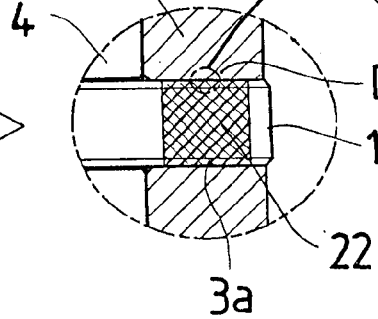
FIG. 5B is a cross sectional view of main points of a valve timing control device as embodiment 3 according to the present invention, and shows a state after adhering the bolt to the input rotational member shown in FIG. 5A.

FIG. 5A is an enlarged fragmentary cross sectional view showing a bolt before adhering to an input rotational member. FIG. 5B is a cross sectional view of main points of a valve timing control device as embodiment 3 according to the present invention, and shows a state after adhering the bolt to the input rotational member shown in FIG. 5A. FIG. 5C is an enlarged fragmentary cross sectional view showing part D of FIG. 5B. Since the common numerals of the embodiment 3 denote common elements in the conventional device of FIG. 1 and FIG. 2 and common elements in the embodiments 1 and 2, the description of such parts is omitted.

In FIG. 5A, FIG. 5B and FIG. 5C, numeral 22 denotes an adhesive applied to the front end of the bolt 11. With the embodiment 3, the adhesive 22 is previously applied to a threaded section of the front end of the bolt 11 to hold it to the bolt threaded hole 3*a* of the input rotational member 3 on assembling the housing 2. The front end of the bolt 11 is then screwed to the bolt threaded hole 3*a* of the input rotational member 32 in a manner similar to the embodiment 1.

According to the embodiment 3, the adhesive 22 exists on the threaded section of the bolt 11. Even if the bolt 11 becomes loosened, it is possible to reduce the loosening to a very slight level due to the adhesion properties of the adhesive in order to prevent the bolt 11 from detachment.

Embodiment 4

Figure 6A:
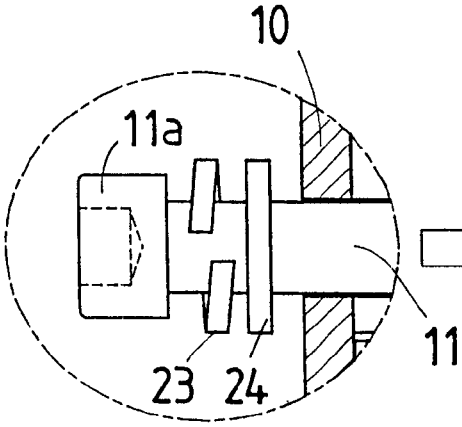
FIG. 6A is an enlarged fragmentary cross sectional view showing a bolt in a part corresponding to part C of FIG. 1 before screwing the bolt to a cover member.
Figure 6B:
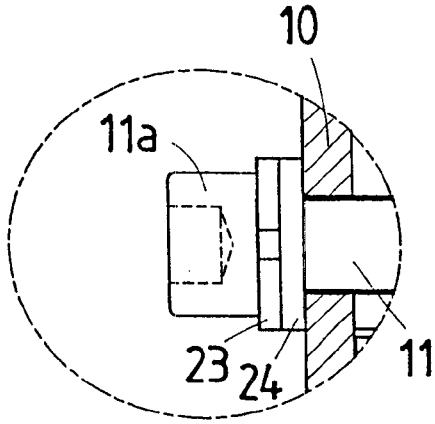
FIG. 6B is a cross sectional view of main points of a valve timing control device as embodiment 4 according to the present invention, and shows a state after screwing the bolt to the cover member shown in FIG. 6A.

FIG. 6A is an enlarged fragmentary cross sectional view showing a bolt in a part corresponding to part C of FIG. 1 before screwing the bolt to a cover member. FIG. 6B is a cross sectional view of main points of a valve timing control device as embodiment 4 according to the present invention, and shows a state after screwing the bolt to the cover member shown in FIG. 6A. Since the common numerals of the embodiment 4 denote common elements in the conventional device of FIG. 1 and FIG. 2 and common elements in the embodiments 1 to 3, the description of such parts is omitted.

In FIG. 6A and FIG. 6B, numeral 23 denotes a spring-washer allowing fitting the bolt 11 therein before assembling the housing 2 of FIG. 1, and numeral 24 denotes a plate washer allowing fitting the bolt 11 therein. The spring-washer 23 and the platy washer 24 are arranged between the head section 11*a* of the bolt 11 and the cover member 10 to act as the detachment prevention means which prevents the loosening and detachment of the bolt 11.

With the embodiment 4, the bolt 11 fitting in the spring-washer 23 and the plate washer 24 passes through the cover member 10 and the case 4 in a manner similar to the embodiment 1. As the front end of the bolt 11 is screwed in the bolt threaded hole 3*a* of the bolt 11, the spring-washer 23 and the plate washer 24 are lodged and pressed between the head section 11*a* and the cover member 10. In this way, it is possible to enhance the engaging strength acting on the threaded section defined between the front end of the bolt 11 and the input rotational member 3 to prevent the loosening and detachment of the bolt 11.

Embodiment 5

Figure 7A:
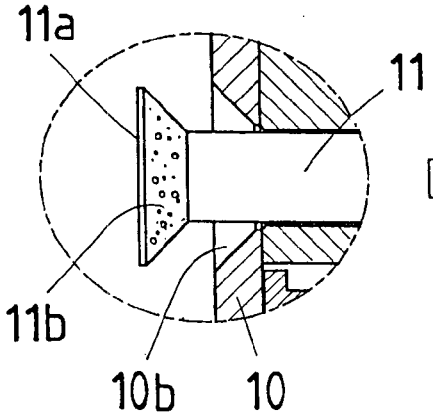
FIG. 7A is an enlarged fragmentary cross sectional view showing a bolt in a part corresponding to part C of FIG. 1 before screwing the bolt to a cover member.
Figure 7B:
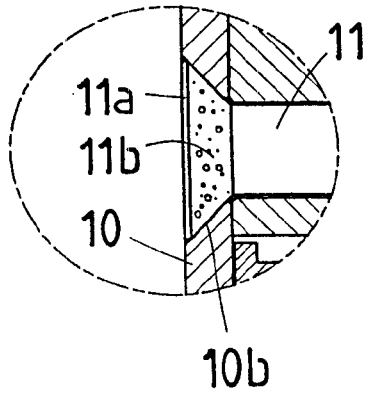
FIG. 7B is a cross sectional view of main points of a valve timing control device as embodiment 5 according to the present invention, and shows a state after screwing the bolt to the cover member shown in FIG. 7A.

FIG. 7A is an enlarged fragmentary cross sectional view showing a bolt in a part corresponding to part C of FIG. 1 before screwing the bolt to a cover member. FIG. 7B is a cross sectional view of main points of a valve timing control device as embodiment 5 according to the present invention, and shows a state after screwing the bolt to the cover member shown in FIG. 7A. Since the common numerals of the embodiment 5 denote common elements in the conventional device of FIG. 1 and FIG. 2 and common elements in the embodiments 1 to 4, the description of such parts is omitted.

With the embodiment 5, a countersunk bolt 11 is used as the bolt. In FIG. 7A and FIG. 7B, numeral 11*a* denotes a head section of the countersunk bolt 11, and numeral 11*b* denotes a tapered seat of the head section 11*a*. The tapered seat 11*b* has a rough-formed surface. Numeral 10*b* denotes a tapered hole formed at the cover member 10. The head section 11*a* of the countersunk bolt 11 is fitted in the tapered hole 10*b* to engage the tapered seat 11*b* with the tapered hole 10*b*.

Moreover, a front end of the countersunk bolt 11 of the embodiment 5 may be welded to the input rotational member 3 in a manner similar to the embodiment 1. The front end may be swaged toward the outer side face of the input rotational member 3 in a manner similar to the embodiment 2. The adhesive may be applied to the front end of the countersunk bolt 11 in a manner similar to the embodiment 3. Shortly, the front end acts as the detachment prevention means to prevent the loosening and detachment of the countersunk bolt 11.

According to the embodiment 5, the tapered seat 11*b* of the head section 11*a* of the countersunk bolt 11 has the rough-formed surface. Conventionally, it is difficult to make practical use of the countersunk bolt 11 as the detachment prevention means because only the outside diameter of the tapered seat 11*b* is partially engaged with the major diameter of the tapered hole 10*b* of the cover member 10. On the other hand, an entire tapered surface of the tapered hole 10*b* can make contact with the tapered seat 11*b*. The countersunk bolt 11 can be used as the threaded member constituting the housing 2. The embodiment 5 can have therefore the same effect as the embodiment 1.

Embodiment 6

With the embodiment 6, the bolt 11 is made of materials whose expansion coefficient is smaller than or equal to that of materials of the input rotational member 3, the case 4 and the cover member 10 which constitute the housing 2. In this way, it is possible to effectively prevent the loosening of the threaded member due to changes in temperature of the internal combustion.

The present invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A valve timing control device, comprising:

a camshaft opening and closing at least one of an intake or an exhaust valve in an internal combustion engine;

an input rotational member arranged on the camshaft to input the rotational driving force of the internal combustion;

a case whose end is assembled in the input rotational member in an axial direction of the case;

a rotor accommodated in the case to rotate relative to the case and coupled to the camshaft;

a cover member disposed at the other end of the case in the axial direction;

a threaded member used for being integrated with the cover member, the case and the input rotational member; and a detachment prevention means arranged at the threaded member to prevent the loosening and detachment of the threaded member.

2. A valve timing control device according to claim 1, wherein the threaded member is a bolt including a head section engaging in any one of the cover member and the input rotational member; and a front end allowing threadable attachment with the other of the cover member and the input rotational member, and wherein the screwed front end of the bolt is welded to the other member, the welds constituting the detachment prevention means.

3. A valve timing control device according to claim 1, wherein the threaded member is a bolt including a head section engaging in any one of the cover member and the input rotational member; and a front end allowing threadable attachment with the other of the cover member and the input rotational member, and wherein the screwed front end of the bolt is swaged and fixed to the other member, the swaging section constituting the detachment prevention means.

4. A valve timing control device according to claim 1, wherein the threaded member is a bolt including a head section engaging in any one of the cover member and the input rotational member; and a front end allowing threadable attachment with the other of the cover member and the input rotational member, and wherein an adhesive acting as the detachment prevention means is applied to the screw section of the bolt.

5. A valve timing control device according to claim 1, wherein the threaded member is made of materials whose expansion coefficient is smaller than or equal to that of materials of a housing constituted by the case, the input rotational member and the cover member.

6. A valve timing control device, comprising:

a camshaft opening and closing at least one of an intake or an exhaust valve in an internal combustion engine;

an input rotational member arranged on the camshaft to input the rotational driving force of the internal combustion;

a case whose end is assembled in the input rotational member in an axial direction of the case;

a rotor accommodated in the case to rotate relative to the case and coupled to the camshaft;

a cover member disposed at the other end of the case in the axial direction;

a threaded member used for being integrated with the cover member, the case and the input rotational member; and a loosening prevention means arranged at the threaded member to prevent the loosening of the threaded member using the screwing force of the threaded member.

7. A valve timing control device according to claim 6, wherein the threaded member is a bolt including a head section engaging in any one of the cover member and the input rotational member; and a front end allowing screw in the other of the cover member and the input rotational member, and wherein a spring-washer acting as the loosening-stop means is disposed between the head section and one of the members engaged with the head section.

8. A valve timing control device according to claim 6, wherein the threaded member is a bolt including a head section engaging in any one of the cover member and the input rotational member; and a front end allowing threadable attachment with the other of the cover member and the input rotational member, and wherein a seat of the head section has a rough surface acting as the loosening prevention means.

9. A valve timing control device according to claim 8, wherein the threaded member is a countersunk bolt whose tapered section acts as a seat of the head section.

10. A valve timing control device according to claim 6, wherein the threaded member is made of materials whose expansion coefficient is smaller than or equal to that of materials of the case, the input rotational member and the cover member which constitute a housing.

* * * * *